United States Patent [19]

Kratzert et al.

[11] Patent Number: 4,940,352

[45] Date of Patent: Jul. 10, 1990

[54] BINDING FOLDER

[75] Inventors: Herbert Kratzert, Pfullendorf-Denkingen; Kurt Schrem, Pfullendorf, both of Fed. Rep. of Germany

[73] Assignee: Kratzert & Schrem GmbH, Fed. Rep. of Germany

[21] Appl. No.: 320,524

[22] Filed: Mar. 8, 1989

[30] Foreign Application Priority Data

Mar. 12, 1988 [DE] Fed. Rep. of Germany ... 8803353[U]

[51] Int. Cl.[5] ..... B42F 13/10

[52] U.S. Cl. ..... 402/13; 402/68

[58] Field of Search ..... 402/13, 68, 80 R

[56] References Cited

U.S. PATENT DOCUMENTS

| | | | |
|---|---|---|---|
| 4,256,411 | 3/1981 | Podosek | 402/13 X |
| 4,261,664 | 4/1981 | Crawford | 402/13 |
| 4,784,507 | 11/1988 | Vetter | 402/68 |

FOREIGN PATENT DOCUMENTS

| | | | |
|---|---|---|---|
| 1200254 | 9/1965 | Fed. Rep. of Germany . | |
| 1229498 | 12/1966 | Fed. Rep. of Germany . | |
| 593999 | 7/1959 | Italy | 402/13 |

*Primary Examiner*—Paul A. Bell

*Attorney, Agent, or Firm*—Evenson, Wands, Edwards, Lenahan & McKeown

[57] ABSTRACT

A binding folder is provided which includes a foldable plastic cover having a bottom part for anchoring fastening strips which extend through perforations in paper sheets to be held. The top part of the cover forms a counterholder with two pairs of slots for respective ends of the fastening strips. The slots are spaced a predetermined distance from one another and are configured to permit sliding movement of the fastening strips during folding movement of the top and bottom parts so that the paper sheets can be manipulated without requiring removal of same. In certain embodiments the counterholder is provided in a separate folding piece.

20 Claims, 3 Drawing Sheets

Fig. 1
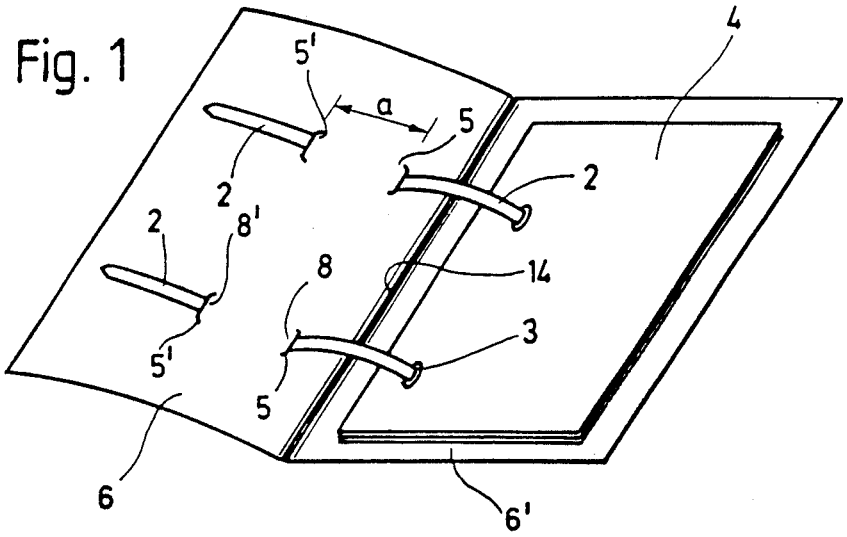
Fig. 2
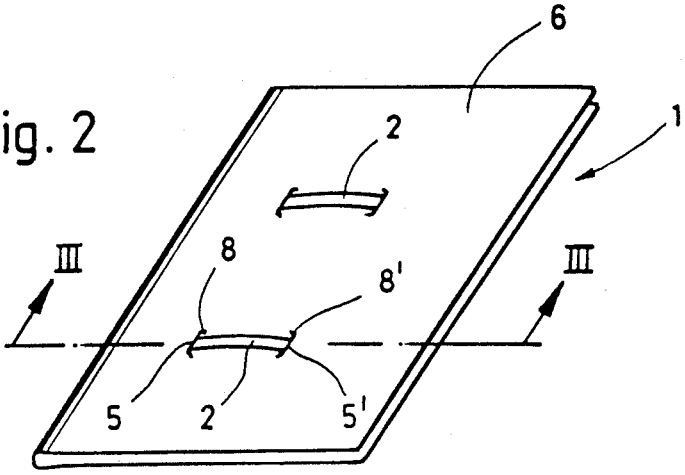
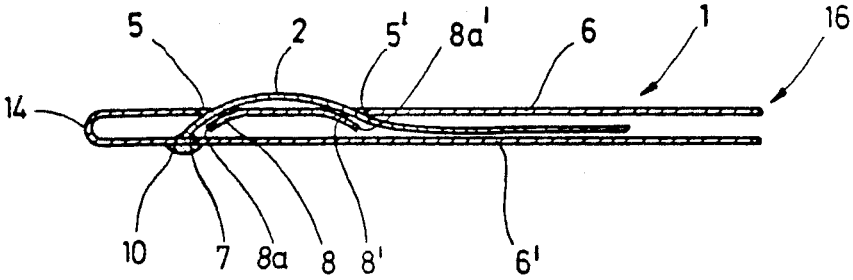
Fig. 3

Fig. 4
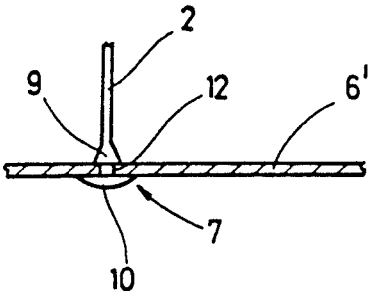
Fig. 5
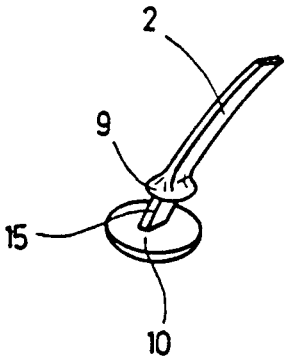
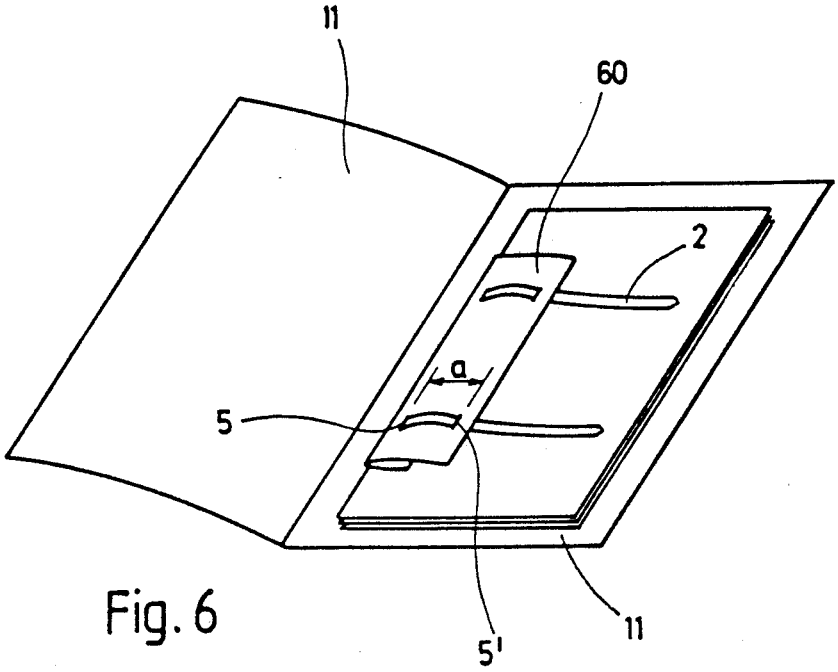
Fig. 6

Fig. 7
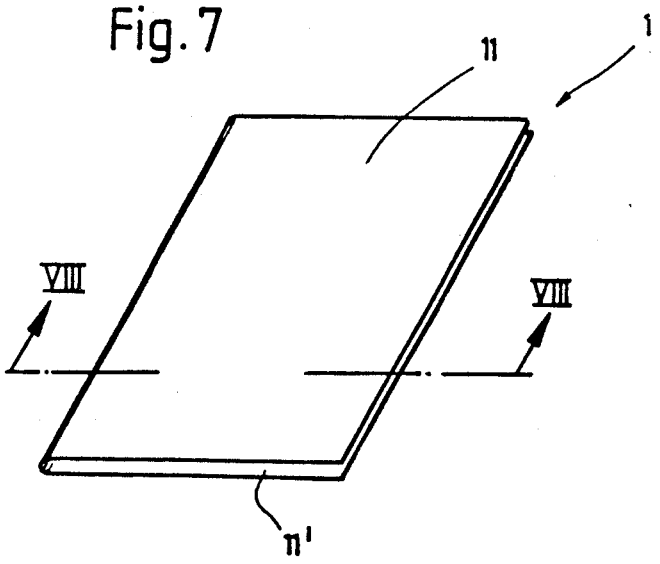
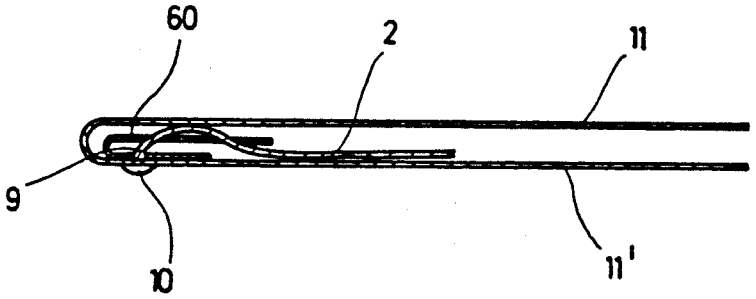
Fig. 8

BINDING FOLDER

BACKGROUND AND SUMMARY OF THE INVENTION

The invention relates to a binding folder for holding paper sheets and the like including strips made of an elastically bendable material which are pulled through perforations in the sheets and extend to a counterholder.

Binding folders of this type are known (Binding Folder No. 8670U of Leitz Co., Stuttgart). In these binding folders, two fastening strips are provided, which project vertically away from a holding piece, consist of plastic, are pulled through corresponding perforations of the paper to be filed and, for fixing the stack of paper, are first pulled through an opening in a relatively stiff holding counterpiece, and from there, can be guided by a lateral pressing-in behind a clamping slot, which is open toward one side and which is directly adjacent to the first pull-through opening. A fixing is caused by this relatively sharp bending of the fastening strip. When paper is to be taken from the filed stack, the holding counterpiece must first be removed by detaching both fastening strips from their clamping slot. The perforations of the paper can then be pulled over the free end of the fastening strip. However, in this design, it is also possible, in order to permit an easier leafing-open of the filed stack, to place the holding counterpiece on the free end of the fastening strips by means of two clamping arms, so that the guiding path of the fastening strip is enlarged for the opening-up of and leafing-through the filed stack, without the occurrence of any undesirable removal of filed sheets from the stack.

In order to permit this type of facilitated turning of pages, however, the holding counterpiece must first be removed and then, with its two clamping arms, must be placed on the fastening strips. This is too inconvenient for some users.

An object of the invention is therefore to develop a binding folder of this type in such a manner that it becomes superfluous to awkwardly remove a counterholder and subsequently return it.

In order to achieve this object, an arrangement is provided wherein the slots in the counterholder include at least one pair of first and second counterholder slots closed on both sides and disposed at a predetermined distance (a) with respect to one another such that a fastening strip of the strip means is guided to be loosely movable through the first and second slots without being immovably clamped. This development makes it possible to hold filed paper, without any separate fixing process for the fastening strips, in a secure manner at the fastening strips without, however, as in the case of all other known binding folders, limiting, to a certain measurement, the free length of the fastening strips pulled through the perforations of the paper. The fastening strip is pulled only loosely through two openings in a counterholder assigned to the holding device of the fastening strips, this counterholder being foldably fastened at the holding device. The folding-open of the counterholder, which may, for example, be the top cover part of a folding cover, is therefore not impaired. The fastening strip slides loosely in the corresponding slots. It must be designed to be sufficiently long in order not to slide out of one of the two guiding slots during the folding-open process.

Advantageous further developments of especially preferred embodiments further enhance the reliability of operation and ease of manufacture of the binding folder. In especially preferred embodiments the slots in the counterholder are formed by punched out tongues. This results in the advantage that, despite the easy guiding of the fastening strips in the counterholder, which is not provided with any additional fixation, an undesirable falling-out of the filed stack of paper does not occur when the binding folder is closed. This is the result of the then occurring relationships of forces which prevent the pulling-out of the fastening strips from their slots by means of the weight of the filed stack of paper. The invention therefore provides the surprising possibility of being able, by a simple opening of the folding cover of a binding folder, to utilize the then longer course of the fastening strip for the leafing-open of the stack of paper.

In preferred embodiments with an arrangement of slot tongues extending oppositely at the spaced apart slots and with the selection of materials for the counterholder and fastening strips to be spring plastic material and unbreakable plastic material respectively, ensures also that the holder and the counterholder are sufficiently stable in order to permit the guiding-through of the fastening strip, without the requirement of carrying-out additional measures. The arrangement of the tongue serves as a guidance and a kind of brake for the fastening strip. The reason is that the springy tongues, which are punched out of the elastic bendable material of the counterholder always place themselves as closely as possible against the fastening strip.

In certain preferred embodiments, the slots or the tongues are arranged directly at the top cover part of a foldable double cover of the binding folder. It is also contemplated to attach in this type of a double cover a foldable holding counterpiece which may simply be fastened, together with the fastening end of the fastening strips, at the bottom cover part of the double cover.

Other objects, advantages and novel features of the present invention will become apparent from the following detailed description of the invention when considered in conjunction with the accompanying drawings.

BRIEF DESCRIPTION OF THE DRAWINGS

FIG. 1 is a schematic, perspective view of a first embodiment of a binding folder constructed according to the invention in the folded-open condition;

FIG. 2 is a view of the binding folder of FIG. 1 in the closed condition;

FIG. 3 is an enlarged sectional view through the binder of FIG. 2 along Line III—III;

FIG. 4 is a partial enlargement of the fastening area of one of the fastening strips of the binding folder according to FIG. 3;

FIG. 5 is a perspective partial representation of the fastening end of the fastening strip which is used in the binding folder of FIGS. 1 to 4;

FIG. 6 is a perspective representation of another embodiment of a binding folder according to the invention, in the folded-open condition;

FIG. 7 is a view of the binding folder of FIG. 6 in the closed condition; and FIG. 8 is a sectional view of the binding folder of FIG. 7 along Line VIII—VIII.

DETAILED DESCRIPTION OF THE DRAWINGS

FIGS. 1 and 2 show a binding folder 1, which consists of a double cover which can be folded in a known manner about a bending line 14, and in which individual sheets 4 of paper provided with perforations 3 are filed. This filing is facilitated by means of two fastening strips 2, which are fastened at the bottom cover part 6' with one end in a manner which will be described below, and which are pulled through the perforations 3. The fastening strips 2 will then be inserted with their free ends into a slot 5 in the top cover part 6 and will be pulled back through a second slot 5' into the inside from the direction of the outside of the top cover part 6. In this case, the two slots 5 and 5' are arranged at a predetermined distance (a) with respect to one another which is selected to be such that the fastening strips 2 do not experience any sharp bending, but are guided through the cover page 6 essentially flat.

As shown in FIGS. 3 and 4, the fastening end of the fastening strips 2 is provided with a button-type contact end 10 which ensures the hold of the fastening strips 2 at the bottom cover part 6' against a pulling-through toward the inside. Opposite the contact button 10, a thickening is provided, which tapers off conically toward the free end of the fastening strip 2 and forms a catch hook 9. The catch hook 9 is formed in that the lower edge of the thickening forms a stop edge with respect to the section 15 located underneath it, the dimensions of this section 15 corresponding approximately to those of the rest of the fastening strip 2. The length of this area 15 between the stop button 10 and the catch hook 9 is matched approximately with the material thickness of the bottom cover part 6' of the foldable double cover. When therefore the fastening strip 2, starting from its free end, is pushed through a corresponding slot opening in cover part 6', it can be fixed in that also the catch hook 9, with an elastic deformation of the material, is pushed through the opening in cover part 6', until the button 10 places itself against the bottom and the locking takes place at the catch hook 9. After the threading-in of the paper 4, the ends of the fastening strips 2 can be pushed through the slots 5, 5' in the described manner.

As shown in FIG. 2, and particularly also in FIG. 3, the slots 5, 5' are formed in that the two tongues 8 and 8' are punched out of the material of the cover part 6, specifically in such a manner that their free edges **8*a* and 8*a'*, in each case, point away from one another. The slots 5, 5' are therefore formed by these free edges 8*a*, 8*a'* of the tongues 8, 8' and the corresponding punched edges in the cover part 6, in which case, when the fastening strip 2 is pushed through, the tongues 8, 8' bend downwards in each case and as a result of their inherent elasticity, are placed against the fastening strip 2**.

In the embodiment shown, the fastening strips 2 and the double cover consisting of cover parts 6 and 6' are advantageously made of a plastic material, such as polypropylene or polyethylene. The use of this material permits using the shown embodiment without the necessity of taking reinforcing measures in the area of the punched-out slots 5, 5'. The fastening strip 2 is guided at the tongues 8, 8' and at the material of the cover part 6 without any significant sharp deflections. In this case, as shown in FIG. 3, the slot 5 and the end edge **8*a* of the tongue 8 are situated approximately such that the slot 5, when the binding folder is closed (FIG. 2), is located approximately above the fastening point 7 of the fastening strip 2, although it is arranged to be slightly offset from the direction of the folding edge 14 with respect to the free end 16 of the binding folder. As a result, the strip, also in the closed position, slides in its guides provided by the tongues 8, 8' and the edges of the slots 5, 5'. It is therefore easily possible to open the binding folder according to FIG. 1, without any type of jamming of the fastening strip. It therefore becomes possible to easily leaf open the filed paper because, between the fastening point and the first slot 5, a large free length of the fastening strip 2 is available in the opened-up condition FIG. 1), on which the perforations 3** can easily be slid back and forth.

When the binding folder is closed, the fastening strip 2 slides in reversed direction in its guides at the tongues 8, 8' and the slot edges of the slots 5, 5'. It pushes itself more back into its guides so that its free end, which moves out of the slot 5', becomes longer again. Because of the selected design in this closed position (see FIG. 3), an undesirable falling-out of the filed paper is not possible. By means of the slightly oblique guidance of the fastening strip 2 in the area between the two approximately parallel extending cover parts 6, 6', a falling-out of the paper is prevented even if the binding folder is held so that its folding edge 14 is up. The reason is that the paper's own weight presses the fastening strip 2 against the first slot 5 and against the free edge **8*a* of the tongue 8 at which the weight of the paper is essentially absorbed. In addition, the free end of the fastening strip 2 is also pressed from the inside through the stack of paper against the interior side of the cover part 6**, so that this also ensures the securing of the filed stack of paper.

It is an advantage of the new design that, for the leafing-open, only the double cover must be opened up in order to permit an easy turning of the pages.

FIGS. 6 to 8 show another embodiment in which, when the binding folder 1 is closed, according to FIG. 7, the fastening strip 2 is not visible. This is achieved in that an additional folding holding device 60 is inserted into the folded double cover which consists of the two cover parts 11 and 11' which can be folded towards one another. This folding holding device 60 is attached by means of the locking fastening of the fastening strip 2 directly to the interior side of the bottom cover part 11'. In this case, the area 15 (compare FIG. 5) of the fastening strip 2 must be designed to be such that it corresponds approximately to the material thicknesses of cover part 11' and of the folding piece 60. The upper folding part of the folding piece 60 is designed with the slots 5, 5' in the same manner as explained by means of FIGS. 1 to 5. In this case, the top cover part 11 must be opened for the leafing-open, and then the top side of the folding piece 60 must be folded open. The slots 5, 5' are arranged at the same distance (a) with respect to one another, as described in the other embodiment. Here also, the slots 5, 5' may be formed by punched-out tongues.

The new binding folder is also suitable for the filing of EDV paper (paper strips for electronic data processing), which is perforated at both ends and, as a rule, is filed in a zig-zag type of folding. In this case, the fastening strips are arranged so far at the outside that they can be pulled through one of the holes respectively at the edges, but apart from that, are held in the same manner as in the shown embodiments.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A binding folder for holding paper sheets and the like having fastening strip means made of an elastically bendable material, which strip means are pulled through perforation means of the paper sheets to be held and extend in slot means of a counterholder, wherein the slot means in the counterholder include at least one pair of first and second counterholder slots closed on both sides and disposed at a predetermined distance (a) with respect to one another such that a fastening strip of the strip means is guided to be loosely movable through said first and second slots without being immovably clamped, when the counterholder slots are formed by punched out tongues, and wherein the free end of the tongue of the first counterholder slot faces away from the free end of the tongue of the second counterholder slot.

2. A binding folder according to claim 1, wherein the first counterholder slot is placed in such a manner that it is located approximately above a fastening point of the fastening strip.

3. A binding folder according to claim 1, wherein the first counterholder slot is placed in such a manner that it is located approximately over the perforation means of the paper sheets after the counterholder is folded over the paper sheets.

4. A binding folder according to claim 3, wherein the first counterholder slot is placed in such a manner that it is located approximately above a fastening point of the fastening strip.

5. A binding folder according to claim 3, wherein said fastening strip means includes a plurality of said fastening strips dispersed parallel to one another, each fastening strip extending through respective corresponding pairs of first and second counterholder slots in said counterholder.

6. A binding folder according to claim 5, wherein said fastening strip means consists of two of said fastening strips.

7. A binding folder according to claim 1, wherein the counterholder is constructed of a relatively stiff and springy Plastic material, particularly polypropylene or polyethylene.

8. A binding folder according to claim 7, wherein the fastening strips are constructed of unbreakable plastic material, particularly polyamide.

9. A binding folder according to claim 1, wherein each fastening strip is equipped with a contact button at its fastening end and with a catch hook which is guided through a fastening opening of a holder which is disposed opposite the counterholder when the binding folder is in a folded closed position.

10. A binding folder according to claim 1, wherein the predetermined distance (a) between the first and second slots formed by the tongues is selected to be of such a size that the fastening strip moves essentially straight through both slots.

11. A binding folder according to claim 1, wherein a cover part of a foldable double cover is used as holder for the fastening strip means, said counterholder being formed by the other cover part of the folding cover.

12. A binding folder according to claim 11, wherein the counterholder is constructed of a relatively stiff and springy plastic material, particularly polypropylene or polyethylene.

13. A binding folder according to claim 1, wherein the counterholder and a holder for the strip means are part of a folding piece which is additionally inserted into a folding cover.

14. A binding folder according to claim 13, wherein the folding piece is mounted at a bottom cover part of the folding cover with a fastening button means and a catch hook means of the fastening strip means.

15. A binding folder according to claim 1, wherein said fastening strip means includes a plurality of said fastening strips dispersed parallel to one another, each fastening strip extending through respective corresponding pairs of first and second counterholder slots in said counterholder.

16. A binding folder according to claim 15, wherein the counterholder is constructed of a relatively stiff and springy plastic material, particularly polypropylene or polyethylene.

17. A binding folder according to claim 16, wherein the fastening strips are constructed of unbreakable plastic material, particularly polyamide.

18. A binding folder according to claim 15, wherein each fastening strip is equipped with a contact button at its fastening end and with a catch hook which is guided through a fastening opening of a holder which is disposed opposite the counterholder when the binding folder is in a folded closed position.

19. A binding folder according to claim 15, wherein the predetermined distance (a) between the first and second slots formed by the tongues is selected to be of such a size that the fastening strip moves essentially straight through both slots.

20. A binding folder according to claim 15, wherein a cover part of a foldable double cover is used as holder for the fastening strip means, said counterholder being formed by the other cover part of the folding cover.

* * * * *